US005304285A

United States Patent [19]

Meinecke et al.

[11] Patent Number: 5,304,285

[45] Date of Patent: Apr. 19, 1994

[54] STOCK-INLET FOR PAPERMAKING MACHINE

[75] Inventors: Albrecht Meinecke; Dieter Egelhof, both of Heidenheim, Fed. Rep. of Germany

[73] Assignee: J.M. Voith GmbH, Fed. Rep. of Germany

[21] Appl. No.: 327,917

[22] PCT Filed: Aug. 19, 1987

[86] PCT No.: PCT/EP87/00464

§ 371 Date: Jan. 25, 1989

§ 102(e) Date: Jan. 25, 1989

[87] PCT Pub. No.: WO88/01318

PCT Pub. Date: Feb. 25, 1988

[30] Foreign Application Priority Data

Aug. 23, 1986 [DE] Fed. Rep. of Germany ..... 3628699

[51] Int. Cl.[5] ..... D21F 1/02

[52] U.S. Cl. ..... 162/339; 162/343; 162/344; 162/346; 162/347

[58] Field of Search ..... 162/343, 339, 336, 344, 162/347, 346

[56] References Cited

U.S. PATENT DOCUMENTS

| | | | |
|---|---|---|---|
| 4,197,159 | 4/1980 | Newns et al. | 162/336 X |
| 4,373,993 | 2/1983 | Fujiwara | 162/344 X |
| 4,406,740 | 9/1983 | Brieu | 162/347 X |
| 4,426,257 | 1/1984 | Antikainen et al. | 162/343 X |

*Primary Examiner*—Thi Dang

*Attorney, Agent, or Firm*—Ostrolenk, Faber, Gerb & Soffen

[57] ABSTRACT

Headbox for paper machines, provided with an output channel in the form of a nozzle, with an output slot for producing a strip of pulp having the width of the machine. The output channel is delimited by two flow guide walls converging toward one another and as a rule by a rear wall. It is divided up into a number of channel sections (32), preferably autonomous, by subdivision of the flow guide walls into wall sections (30, 31) and preferably by subdivision of the rear wall into rear wall sections (37). Each channel section may have at least one input line (40) of its own, as well as (for adjusting the opening of the output slot) a section of part of the mobile wall (35) and an associated regulating system (38, 39).

21 Claims, 3 Drawing Sheets

Fig.4
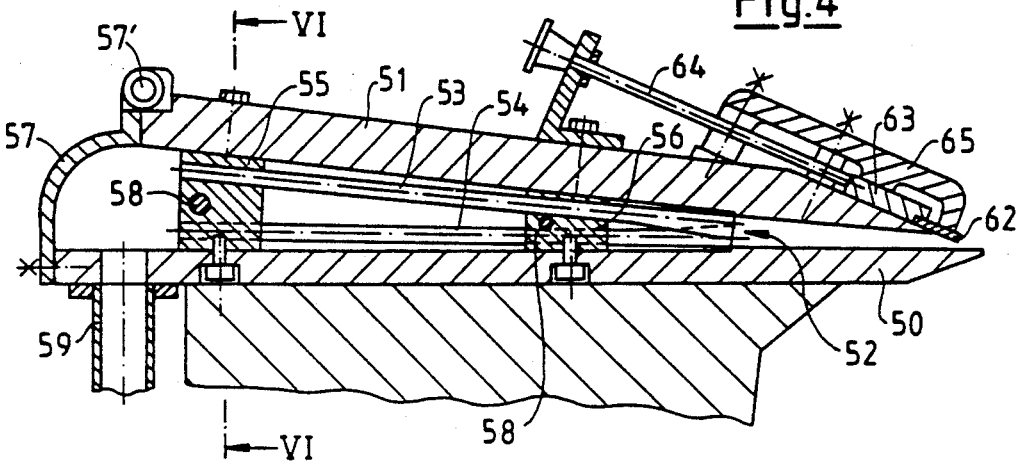
Fig.5
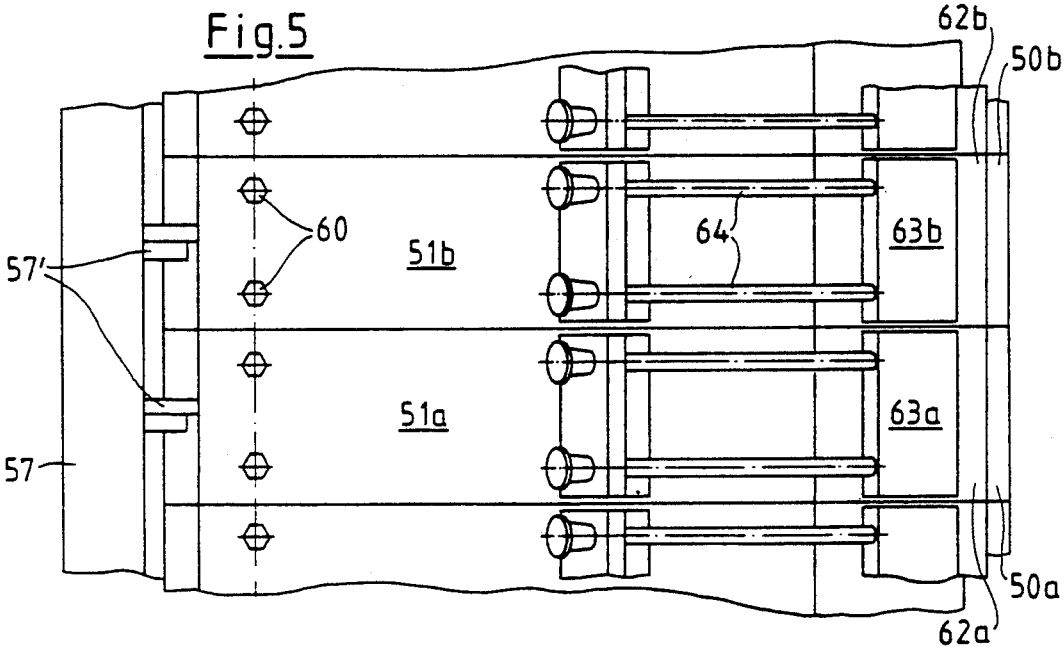
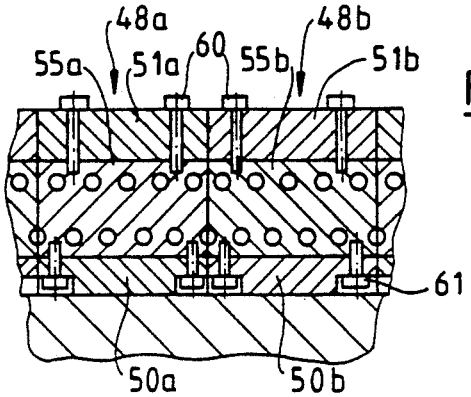
Fig.6

STOCK-INLET FOR PAPERMAKING MACHINE

BACKGROUND OF THE INVENTION

The invention relates to a stock-inlet or head box for a papermaking machine. Among the essential components of this stock-inlet are two converging flow-guidance walls which are as wide as the machine and which, together with a rear wall and with two lateral walls, define a nozzle-like outlet-channel as wide as the machine. Located at the downstream end of the flow-guidance walls, which are also known as the lower lip and the upper lip, is an outlet-gap as wide as the machine, from which the paper-stock emerges, in the form of a jet as wide as the machine, onto a circulating wire-screen upon which the paper web is formed.

Known stock-inlets of this kind are described in the following publications:

1. C.A.-PS 849,817,
2. U.S. Pat. No. 3,373,080,
3. U.S. Pat. No. 4,198,270 (=DE 27 26 709),
4. U.S. Pat. No. 4,455,197,
5. U.S. Pat. No. 4,552,619,
6. U.S. Pat. No. 2,920,699,
7. U.S. Pat. No. 3,846,229 (=DE 23 02 196)

One serious problem with such stock-inlets is maintaining the internal width of the above-mentioned outlet-gap constant over the width of the machine. It has been found, in practice, that the presence of local deviations from the desired width of the gap impairs the quality of the resulting strip of paper. More particularly, it produces an irregular weight-per-unit-of-area transverse profile. For instance, it has been found that a specific change in gap-width increases the weight per unit of area of the strip of paper by a factor of 10.

Another problem is that certain changes in gap-width may occur only when the machine is in operation and thereafter disappear only partly. Such changes are brought about by temperature fluctuations, for example, especially if, after a shut-down, the papermaking machine is started up again with heated stock. In this case, the flow-guidance walls assume only gradually the higher temperature of the stock.

Changes in gap-width which occur in different degrees at different locations over the width of the machine are particularly troublesome. For instance, a flow of cold air entering the mill (such as, when a door is opened) may cause a one-sided change in gap-width. Other uneven changes in gap-width appear to be caused by stiffening ribs which are used, in certain known designs, to reinforce the flow-guidance walls.

In Publication 1, a description is given of a stock-inlet, the lower flow-guidance wall of which is supported on a foundation by a hollow carrier. The problem upon which this publication is based is that the upper part of the hollow carrier, adjoining the flow-guidance wall, assumes a higher temperature than the lower part. The top, therefore, expands more than the bottom and the lower flow-guidance wall, therefore, becomes warped. In-order to overcome this problem, it is suggested that the lower part of the hollow carrier be kept at the same temperature as the upper part by means of a heating device.

In the case of the stock-inlet according to Publication 4, a bundle of pipes, and flow-guidance walls attached thereto, runs through the interior of a hollow stock-inlet housing. A pivotably mounted upper lip is formed by one of the walls of a cross-sectionally triangular hollow carrier. In order to keep the parts of the stock inlet at a specific temperature, water is passed through the interior of the stock-inlet housing and through the upper-lip hollow carrier, separate from the paper-stock, of course. According to FIG. 6, a rectangular hollow carrier is built onto the triangular hollow carrier, which, according to FIG. 1 serves to support the adjusting spindles. In order to ensure that, in the event of a change in temperature a corresponding change in length of the triangular hollow carrier can take place unimpededly, rectangular hollow carrier 54 in FIG. 7 is divided into sections distributed over the width of the machine.

In the stock-inlet described in Publication 5, the flow-guidance walls are again reinforced by hollow carriers. As in Publication 1, steps are taken to ensure that the hollow carrier, and thus the flow-guidance walls, do not become warped by differences in temperature.

None of these known arrangements has produced satisfactory results. On the one hand, stiffening the flow-guidance walls with hollow carriers leads to very costly and bulky designs. On the other hand, the devices used to maintain uniform temperatures do not react fast enough, at least when the papermaking machine is started up. This means that, when the machine is started up, there is still a danger of the flow-guidance walls expanding faster than the opposing wall of the hollow carrier. There is also frequently a danger of at least one of the two flow-guidance walls being temporarily unevenly heated. For instance, it is possible for the inside of a flow-guidance wall in contact with the paper-stock to be at a higher temperature than the outside. This may also cause the relevant flow-guidance wall to arch inwardly in the central part of the width of the papermaking machine, thus reducing the internal width of the outlet-gap. This danger may be even greater if, as in Publication 3, the flow-guidance walls are in the form of simple, self-supporting plates with no stiffening hollow carriers. In the simplest case, the two converging flow-guidance walls are secured rigidly to a carrier-element extending over the width of the machine, for example to a rear wall of the outlet-channel in which a bundle of tubes which feed the paper-stock is arranged.

SUMMARY OF THE INVENTION

It is the problem of the invention to design a stock-inlet of the type described at the beginning hereof in such a manner that the internal width of the outlet-gap can be kept constant as accurately as possible over the width of the machine, without any need of costly heating or cooling devices and/or stiffening structure for the flow-guidance walls.

This problem is solved by a number of features. The important steps of the invention consists in that the outlet-channel is divided into a plurality of sections arranged in a row over the width of the machine. In this connection, it is essential that each of these channel-sections be in the form of a C-shaped "clamp" which is itself rigid, so that it can withstand the internal pressure obtained in the outlet-channel. This eliminates the need for the stiffeners arranged, in many existing stock-inlets, externally of the outlet-channel, e.g. in the form of the previously mentioned hollow carriers. However, the outlet-channel will usually be supported, as heretofore, upon a stationary component common to all channel-sections, e.g. a baseplate.

The division of the outlet-channel into sections may be carried out in various ways as set forth hereinafter in detail. As a rule, however, a section of the one flow-guidance wall and a section of the other flow-guidance wall is associated with each channel-section, i.e. the two flow-,guidance walls are preferably divided similarly and thus into an equal number of sections (but it is-also conceivable to divide the two flow-guidance walls into different numbers of sections).

It is common to all embodiments of the invention that wall sections are connected detachably to each other (and to the two lateral defining walls). The advantage of this is that, in the event of mechanical damage to a part of the flow-guidance wall, there is no need to replace the whole wall with a new one, and only the damaged section need be replaced. The cost of such a replacement, therefore, is decreased to a small fraction of the cost of replacing the whole wall. Moreover, a replacement of this kind may be carried out in much less time. This shortens the downtime and thus provides further substantial savings.

However, the main advantage consists in the fundamental effect of the invention described below:

If the insides of the flow-guidance walls are exposed to a sudden change in temperature, for example when the papermaking machine is started up and heated stock starts to flow through the outlet-channel and, for a certain length of time, the inside of one flow-guidance wall is at a higher temperature than the outside, then, because it is divided into sections, the wall no longer arches as a whole. Instead, under the action of this temperature difference, each wall-section arches on its own, without affecting adjacent wall-sections. The amount by which each section arches, therefore, is only a small fraction of the arching to which a flow-guidance wall made in one piece is subjected. Thus, the number of wall-sections making up a flow-guidance wall according to the invention need be large enough only to keep the amount of arching of each section so small that it causes no trouble.

Therefore, an important advantage of the invention is that it at least largely eliminates the heating or cooling equipment provided according to the prior art. but in spite of this the internal width of the outlet-gap can be kept constant over the width of the machine with far greater accuracy than heretofore.

A first group of embodiments is characterized in that each channel-section is in the form of a substantially C-shaped clamp, i.e. it constitutes a mechanically self-supporting element so that, when the stock-inlet is assembled, one self-supporting channel-section may be placed beside the other. In this case, the rear wall of the outlet-channel also is divided into rear-wall-sections. Preferably the spacing (between the joints) of the rear-wall-sections is equal to that of the wall-sections. However, the spacing of the rear-wall sections also may equal twice the division of the wall-sections, in which case one self-supporting channel-section would consist of one rear-wall section and a total of four wall-sections.

In the case of another group of examples, the rear wall provided is arranged at the feed end of the outlet-channel and is common to the stock-inlet as a whole. In other words, the rear wall extends in one piece transversely over the width of the machine and each of the wall-sections is secured to the rear wall.

However, the different embodiments of the invention may also be categorized from other points of view, namely by the way in which the two wall-sections of a channel-section are joined together in order to form a structure which will withstand the internal pressure. The following are some of the possibilities: 1. the two wall-sections are combined to form a one-piece element, manufactured preferably by casting; 2. the feed-ends of the two wall-sections are shaped in such a manner that they may be screwed directly to each other; 3. the two wall-sections are coupled together solely by means of a separate rear wall or rear-wall section; 4. the two wall-sections are coupled together by means of a built-in element (a flow-grating, a bundle of turbulence-tubes, or the like) or by means of a plurality or such built-in elements; and 5. the two wall-sections are coupled together by means of a rear wall and also by means of at least one built-in element.

As in the case of known stock-inlets, the design according to the invention usually comprises a device for adjusting the internal width of the outlet-gap; this may be in the form of an adjustable slice lip, or of a mobile, downstream part of the flow-guidance wall. According to another concept of the invention, the adjusting device is divided into sections like the flow-guidance wall associated therewith. This provides an additional significant advantage which will be explained hereinafter in greater detail in conjunction with an example of embodiment having a mobile flow-guidance wall.

In known stock-inlets, the one-piece, mobile flow-guidance wall (usually the upper lip) which extends over the width of the machine and which, as a rule, has each of its ends supported by a lifting spindle, constitutes a beam loaded by internal pressure and or considerable length. The sag in such a beam is known to be proportional to the third power of the length thereof. For this reason, a one-piece upper lip of this kind must be reinforced, for example by means of a heavy carrier and/or by means of reinforcing ribs. According to the invention, however, a mobile flow-guidance wall of this kind is divided into numerous mobile wall-sections arranged in a row, the length of each section measured at right angles to the length of the machine, being only a fraction of the length of a one-piece mobile flow-guidance wall. Thus, the sag of each of these mobile wall-sections, under the internal pressure, is negligeable. This fact even makes it possible for the mobile wall-sections to have relatively thin walls which provides a considerable saving in material. This also eliminates, for example, reinforcing ribs which as already mentioned hereinbefore have hitherto been the cause of irregular changes in the internal width of the outlet gap. Also eliminated are the lifting devices hitherto needed to adjust the one-piece, mobile upper lip.

Publication 7 describes a stock-inlet having a plurality of feed tubes lying side by side. According to the diagrammatical representations of FIGS. 5 and 6, sections of the upper and lower walls of an outlet-channel as wide as the machine are connected to each feed-tube. In contrast to this, FIG. 7, which is a "practical realization", shows one-piece walls 161 and 171. In this connection, the specification states that "A top wall 161 and a bottom wall 171 serve in common as the top and bottom walls, respectively, of each of the flow-path tubes 15" (column 8, line 27 et seq.). According to the stated object in Publication 7, this known stock-inlet is intended to produce micro-turbulence in the flow of stock in order to ensure that the fibrous material in the paper shall be distributed as uniformly as possible. To this end, a "spin-inducing vane" is provided in each feed-tube, and this is followed by a "rectifier vane" in the outlet-channel. The intent of the structure in this publication, therefore, is totally different. The problems mentioned hereinbefore and the characteristics of the invention serving mainly to solve these problems, are not disclosed in Publication 7.

The solution according to the invention, namely dividing the outlet-channel into sections, may be combined with measures already known. For instance a stock-inlet according to the invention may be set upon a baseplate running at right angles over the width of the machine, or upon a transverse carrier, and these may be kept at the temperature of the paper-stock by means of a heating device.

BRIEF DESCRIPTION OF THE DRAWINGS

Some embodiments of the invention are described further with reference to the accompanying drawings, in which:

FIG. 4 shows another embodiment in longitudinal section;

FIG. 5 shows a view of the stock-inlet of FIG. 4 from above;

FIG. 6 shows a part-cross-section along the line VI—VI in FIG. 4;

DESCRIPTION OF THE PREFERRED EMBODIMENTS

Figure 1:
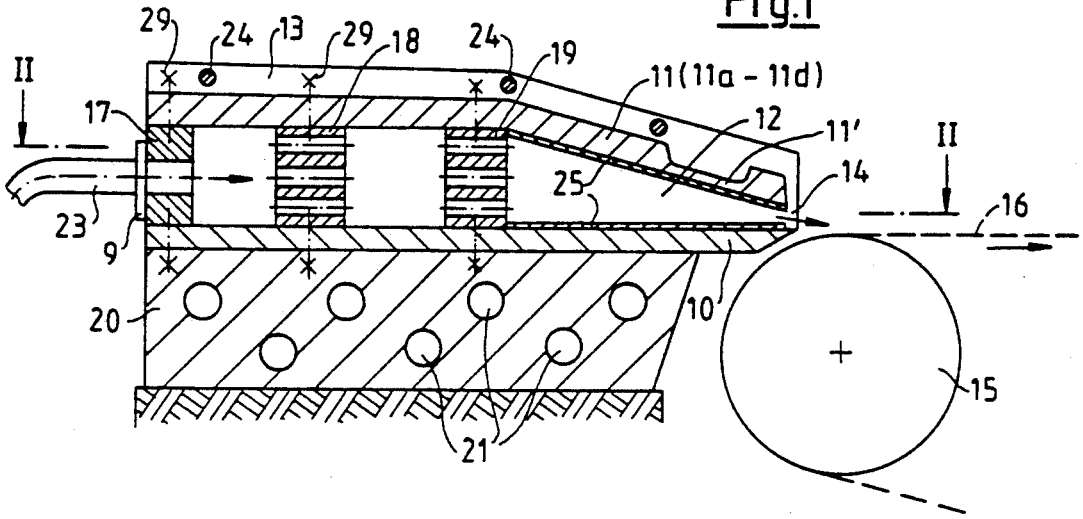
FIG. 1 shows a longitudinal section through a stock-inlet.
Figure 2:
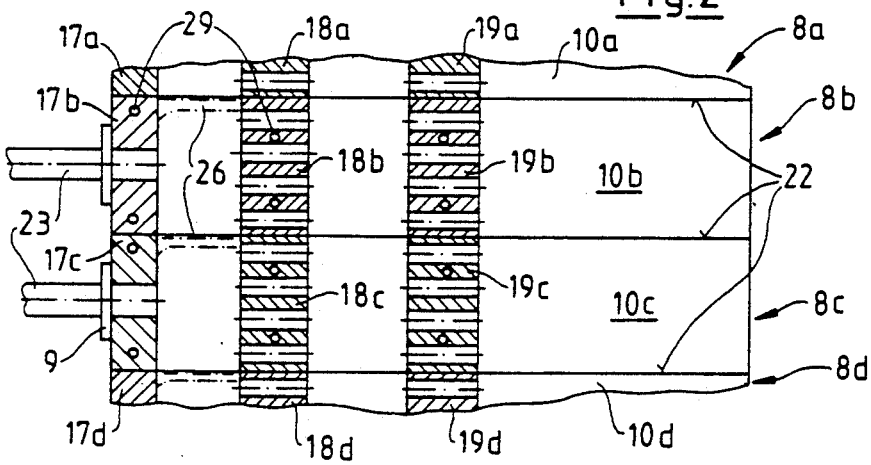
FIG. 2 shows a section along the line II—II in FIG. 1.

The stock-inlet for a papermaking machine, shown diagrammatically and simplified in FIGS. 1 and 2, comprises a lower flow-guidance wall 10 and an upper flow-guidance wall 11 defining an outlet-channel 12 which is, as usual, as wide as the machine. The flow through this device is substantially horizontal and from left to right in the drawing. The flow-guidance walls, which initially run in parallel, but thereafter converge in the downstream area, form an outlet-gap 14 as wide as the machine. The jet of stock, as wide as the machine, emerging from the gap, passes, as usual, in the vicinity of a breast-roll 15, onto an endless circulating wire-screen 16 in the wire-part -of the papermaking machine. In addition to the arrangement shown, in which the direction of flow through the stock-inlet is approximately horizontal, any other possible direction of flow may be used within the scope of the invention, e.g. the flow may be in a vertically upward or obliquely upward direction, the latter being customary in conjunction with a double-wire, for example.

The upstream ends of flow-guidance walls 10 and 11 are connected together rigidly by means of a rear wall 17 and, in the central area, by two flow-grating blocks 18 and 19 arranged one behind the other. The stock-inlet rests upon a baseplate 20, the temperature of which can be set to a specific value, for example by supplying heat through heating ducts 21.

As may be gathered from FIG. 2, lower flow-guidance wall 10, rear wall 17, and flow-grating blocks 18 and 19 are divided into sections of equal width. The sections of the lower wall are marked 10*a*, 10*b*, 10*c* and 10*d*, while the sections of the rear wall are marked 17*a*, 17*b*, 17*c* and 17*d*. In the same way, the sections of the flow-grating blocks are marked 18*a*, 18*b*, 18*c* and 18*d* and 19*a*, 19*b*, 19*c* and 19*d*. Upper flow-guidance wall 11, not shown in FIG. 2, is divided similarly.

Each of the lower wall-sections, e.g. 10*b*, forms, with the relevant upper wall-section 11*b*, with the relevant rear-wall section 17*b*, and with flow-grating sections 18*b* and 19*b*, a so-called channel-section 8*b*. Wall-sections 10*b* and 11*b* are screwed to sections 17*b*, 18*b* and 19*b* of the rear wall and of the flow-grating blocks, in such a manner that the channel-section forms an element of the outlet-channel which withstands internal pressure. The screws are indicated diagrammatically in the drawing, for example at 29.

At least one feed-pipe 23 opens into each channel-section 8*a*–8*d*. The feed-pipes are connected in known fashion to a stock-distributing system. The latter may be in the form of a distributor-pipe running transversely over the width of the machine or, according to Publication 6, in the form of a so-called damping container comprising an air-cushion. A control-valve (not shown in the drawing) may be incorporated into each feed-pipe 23 for local regulation of the incoming stock. The adjustment of this control-valve may be carried out by an automatic unit which keeps the weight per unit of area of the strip of paper (the so-called weight-per-unit-of-area transverse profile), largely constant.

Each upper wall-section 11*a* to 11*d* has a weak-spot 11' which is used to adjust the internal width of outlet-gap 14. The relevant adjusting device has been omitted from FIG. 1.

The joints between channel-sections 8*a* to 8*d* are liquid-tight, but the sealing elements are not visible in the drawing. The channel-sections may be braced to each other, and to the lateral walls, by means of tension-rods 24 running transversely over the width of the machine. One of the two lateral walls is shown in FIG. 1 at 13. If necessary, the insides of the flow-guidance walls can be covered, in the nozzle-like portion of outlet-channel 12, with a piece of foil 25, in order to bridge-over possible irregularities in joints 22. The material used for this purpose should have the lowest possible coefficient of linear expansion. The foil may be securely attached to the relevant wall-sections (e.g. 10*a* to 10*d*), for example, by gluing, so that the foil always expands together with the wall-sections under the influence of heat.

If necessary, the stock-inlet according to FIGS. 1 and 2 can be modified so that the feed-end areas of channel-sections 8*a* to 8*d* are further divided by partitions 26. These partitions, shown in dotted lines in FIG. 2, may be combined with rear-wan sections 17*a* to 17*d*.

Figure 3:
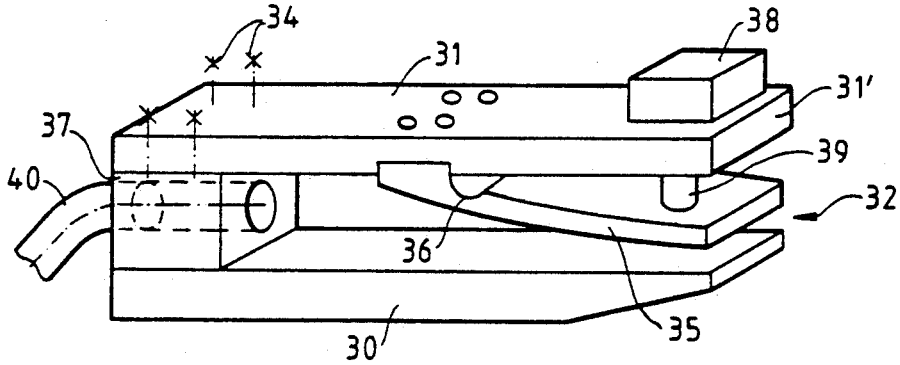
FIG. 3 shows, in perspective, a single channel-section of an example of embodiment differing from that in FIGS. 1 and 2.

Individual channel-section 32, in the embodiment shown in FIG. 3, comprises a lower wall-section 30, an upper wall-section 31, and a rear-wall section 37. In contrast to FIGS. 1 and 2, wall-sections 30 and 31 are now connected rigidly together solely by rear-wall section 37 (by means of screws 34 shown diagrammatically). Also in contrast to FIG. 1, wall-sections 30 and 31, since they form the structure resistant to internal pressure, run in parallel with each other over their entire length. In this case, a nozzle-like outlet-channel is formed in that an intermediate wall-section 35, converging towards wall-section 30, is arranged on the inside of upper wall-section 31. This intermediate wall-section is flexible, due to a weak-spot 36, for example. The downstream end of intermediate wall-section 35 is coupled to an adjusting device 38 arranged upon part 311 of upper wall-section 31, for example, by means of at least on lifting spindle 39.

A feed-line passing through rear-wall section 37 is marked 40. A flow-grating, serving to even-out the flow of stock, is not shown in FIG. 3. In contrast to FIG. 3 an additional, flexible intermediate wall-section may be arranged on lower wall-section 30, symmetrically with upper intermediate wall-section 35.

Outlet-channel 12, in the examples of embodiment illustrated, tapers substantially linearly as far as outlet-gap 14, but designs other than this may be used, for example in accordance with publication 2, where the flow-guidance walls comprise, in symmetrical arrangement, S-shaped inner surfaces, in order to achieve a narrow gap-width in a short distance which is retained, over a relatively long section, as far as the outlet-opening. It is also possible to use an asymmetrical arrangement, with only one flow-guidance wall having an S-shaped internal surface, the other wall having a substantially flat internal surface.

The stock-inlet illustrated in FIGS. 4 to 6 has a lower flow guidance wall 50 and an upper flow-guidance wall 51. Located between these is a bundle of turbulence-tubes as used in conventional stock-inlets and marked as a whole with 52. In the example illustrated, there are two rows 53 and 54 of turbulence-tubes arranged one above the other which converge towards each other at approximately the same angle as the two flow-guidance walls. The turbulence-tubes are embedded in two transverse walls 55 and 56.

As is best seen in FIG. 6, flow-guidance walls 50 and 51 and transverse wall 55 (as well as transverse wall 56) are divided into equal sections. Only two of these are fully visible, namely those marked 50*a*, 50*b*; 51*a*, 51*b*; 55*a*, 55*b*. The wall-sections are connected by means of screws 60 and 61 to the transverse wall-sections and, in this way, are brought together to form a rigid channel-section 48*a*,48*b*. If one compares the FIGS. 4 to 6 with the FIGS. 1 and 2, then, in FIGS. 4 to 6, the transverse wall (="internal rear wall") 55, arranged close to the feed end, has assumed the stiffening function of the rear wall 17 of FIGS. 1 and 2. In this case, an "external rear wall" 57 extends in one piece over the whole width of the machine, is secured by means of hinges 571 to upper wall-sections 51 and can be swivelled up for cleaning purposes. The external rear wall 57, therefore, does not assist (or does not assist very much) in stiffening the channel-sections. Again, at least one feed-line 59 opens into each channel-section and, in this case, is connected to lower wall-section 50.

The channel-sections and the lateral walls (not visible) are braced together in a liquid-tight manner with the aid of tension-rods 58 extending transversely through transverse walls 55 and 56. In contrast to FIGS. 4 to 6, the wall-sections (50*a*, 50*b*; 51*a*, 51*b* etc.) also may be secured to a bundle of turbulence-tubes not divided into sections and having transverse walls extending in one piece over the width of the machine. This arrangement eliminates tension-rods 58.

In order to adjust the inside width of the outlet gap, a slice lip 62 (62*a*, 62*b*), divided into sections, is provided. Each section is secured to a holder 63 (63*a*, 63*b*) also divided into sections, with which at least two adjusting spindles 64 engage. Each slice lip-section 62*a*, 62*b* is held, together with the relevant holder-section 63*a*, 63*b*, against the fluid-pressure on the relevant wall-section 51*a*, 52*a*, by means of an abutment 65 (omitted from FIG. 5) which is also divided into sections. Adjusting spindles 64 may be actuated jointly with, or separately from, each other. In this way, each slice lip-section 62*a*, 62*b* can be moved in parallel or can also be set at an angle, within certain limits. As is known, conventional slice lips extend in one piece over the entire width of the machine, local precision adjustment of the width of the outlet-gap being effected by deforming the slice lip. In the embodiment of FIG. 5 no such deformation is provided. If necessary, however, more than two adjusting spindles may also be provided for each slice lip-section 62*a*, 62*b*, and deformation of the slice lip-section is therefore also possible.

Figure 7:
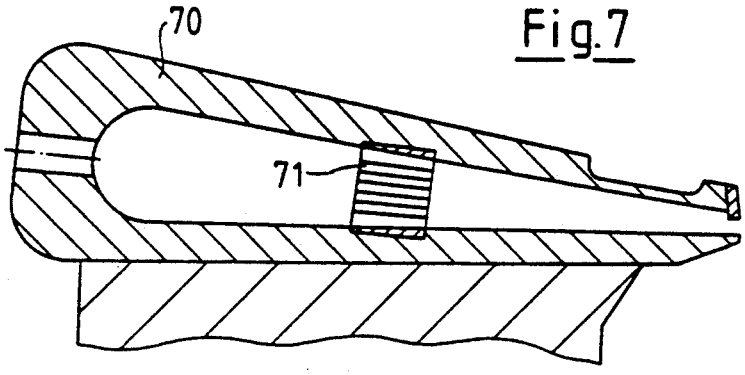
FIG. 7 shows a channel-section in the form of a one-piece element.

FIG. 7 shows diagrammatically that the structure of each channel-section withstanding internal pressure may also be designed as a one-piece element 70. An element of this kind may be a casting. Since, as in the case of previously described examples, it has only a small width in the transverse direction of the machine, the inner surface in contact with the flow of stock may be smoothed mechanically. If necessary, a flow-grating 71 may be inserted into the outlet channel as in FIGS. 1 and 2 but, in contrast to FIG. 1, this need not assist in stiffening the channel-section. Elimination of the screws in the flow-grating thus makes an enlarged flow-section available.

Figure 8:
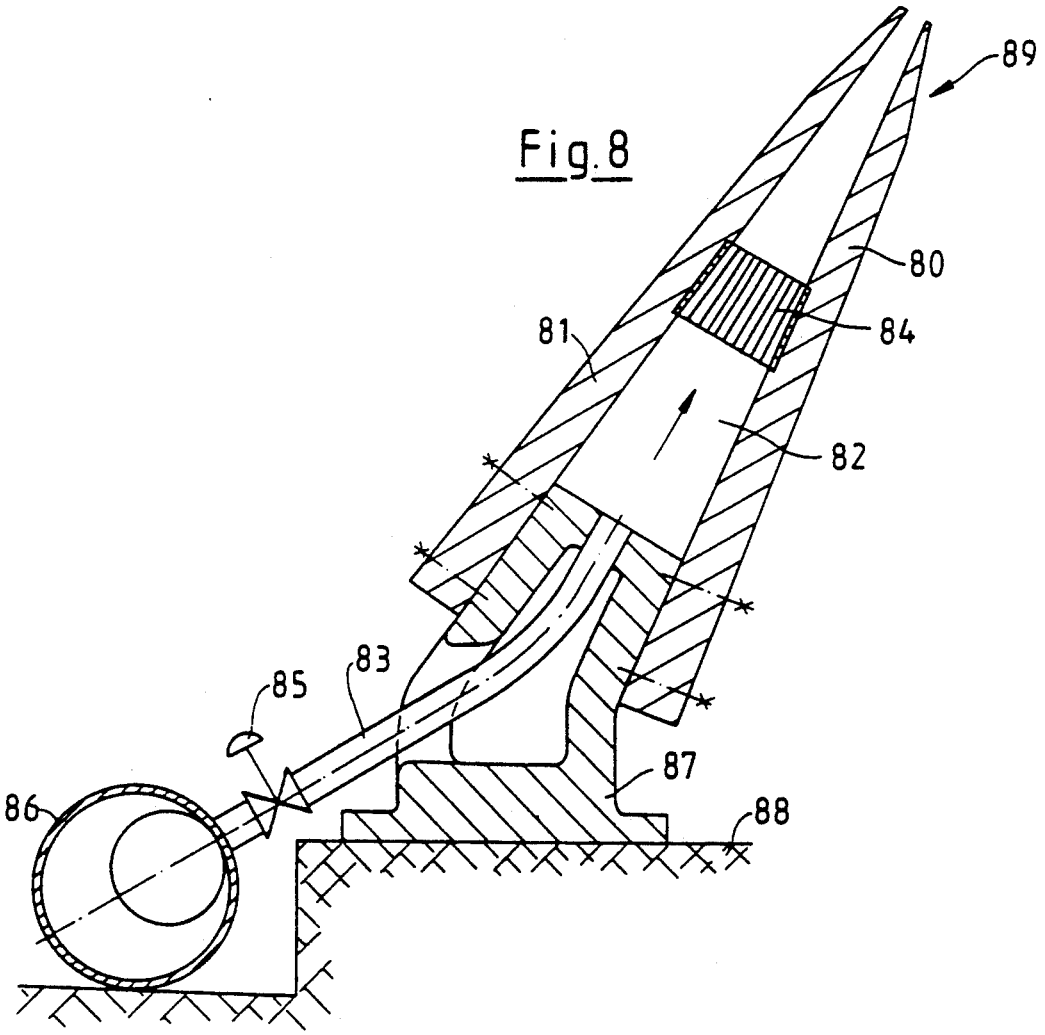
FIG. 8 shows an embodiment for a twin-wire papermaking machine, in longitudinal section.

Common to all the embodiments described above is the fact that the stock-inlet, with the lower flow-guidance wall, rests upon a foundation, a baseplate or the like. FIG. 8 shows an embodiment which differs from this.

In this case the stock-inlet rests, through rear wall 87, upon a foundation 88 and the direction of flow is not horizontal but is obliquely upwards, as required for known twin-wire papermaking machines. Flow-guidance walls 80 and 81 are screwed to rear wall 87 which also may be divided into sections, as in FIG. 2 or 3, but it also may extend in one piece over the entire width of the machine. In both cases, each two sections, belonging to each other, of flow-guidance walls 80 and 81 together form, with rear wall 87, a channel-section 89. A conventional transverse distributor-pipe 86 is provided to produce a flow of stock as wide as the machine. Connected to the pipe are several feed-pipes 83 distributed over the width of the machine, extending through rear wall 87, and opening into outlet-channel 82. Each feed-pipe contains a control-valve 85. As in FIG. 7, a flow-grating 84 may be fitted in the outlet-channel and divided into sections just like the flow-guidance walls. However, these divisions must not agree with the divisions in channel-sections 89. Instead, it may be desirable to arrange in each channel-section two grating sections of half the width.

For the sake of clarity, the tension-rods running transversely through the stock-inlet (like tension-rods 24 in FIG. 1) are omitted from FIGS. 7 and 8, as is the adjusting device for the internal width of the outlet-gap.

We claim:

1. A stock inlet for a papermaking machine, comprising:

a first and a second stock flow guidance wall which are spaced apart and converge to define an outlet channel between them, the outlet channel terminating at a downstream end in an outlet gap for the stock; the flow guidance walls, and the outlet channel defined by the first and second walls and the outlet gap all extending the width of the machine;

opposite lateral walls at the opposite lateral sides of the first and second walls closing the channel between the walls;

means for supplying stock into the channel between the first and second flow guidance walls upstream of the outlet gap;

across the width of the outlet channel, each of the first and the second flow guidance walls comprises a respective plurality of non-overlapping wall sections, the wall sections of each of the first and the second walls being arranged in a row over the width of the outlet channel; means connecting adjacent wall sections of the first wall to each other and of the second wall to each other in liquid tight fashion and also connecting the outermost wall sections of the first and second walls to the lateral walls in liquid tight fashion;

a rear supporting element located toward the upstream end of the channel with respect to the direction of flow of stock and between the first and second walls for supporting and spacing apart the first and second walls, and as seen in longitudinal sections through the outlet channel, one respective wall section of the first wall and one respective wall section of the second wall together with the rear supporting element define a respective outlet channel section which opens toward the downstream end of the channel toward the outlet gap, the outlet channel section is generally C-shaped, the channel sections also extending in a row across the with of the machine; the rear supporting element cooperating with the respective wall sections of the first and second walls to define a rigid clamp assembly capable of withstanding the internal pressure within the outlet channel and at the outlet gap.

2. The stock-inlet of claim 1, wherein the wall sections of the first wall and the wall sections of the second wall are of respective shapes and widths across the width of the machine with a respective wall section in the first wall and a respective wall section of the second wall defining each of the plurality of channel sections across the width of the machine.

3. The stock inlet of claim 2, further comprising:

additional elements within the outlet channel downstream of the rear supporting element for affecting the nature of the flow through the outlet channel.

4. The stock-inlet of claim 3, wherein the additional element sin the channel comprise a stiffening tie element for the respective first wall section and second wall sections in a respective channel section for stiffening the first and second wall sections and tying them together.

5. The stock-inlet of claim 4, wherein the additional elements in the channel are divided across the width of the machine into a plurality of sections, with each section of the additional elements being of the width of and being so placed as to be within a respective section of the channel which also includes the respective first wall section and second wall section of the channel section.

6. The stock-inlet of claim 5, wherein some of the additional element sections also overlap the joints between adjacent first wall sections.

7. The stock-inlet of claim 3, wherein the additional means comprise a flow grating in the channel.

8. The stock-inlet of claim 3, wherein the additional means comprise a bundle of turbulence tubes in the channel and permitting flow therethrough along the channel.

9. The stock-inlet of claim 2, wherein adjacent ones of the channel sections are detachably connected to each other and the outermost channel sections in the row thereof are connected to the lateral walls.

10. The stock-inlet of claim 9, wherein the rear supporting element is also divided into sections, and the sections of the rear supporting element being of such dimensions and being so placed as to correspond to the placement and width of the wall sections of the first and second walls in the respective channel sections of the channel, wherein each of the channel sections includes a respective first wall section, second wall section and rear wall section.

11. The stock-inlet of claim 2, further comprising a device for adjusting the height of the outlet gap for controlling the exit flow therepast, the adjusting device also being divided into sections, and each of the sections thereof being in one of the channel sections.

12. The stock-inlet of claim 11, wherein the adjusting device comprises an adjustable slice lip in the channel.

13. The stock-inlet of claim 12, wherein the slice lip is divided across the width of the machine into slice lip sections, with a respective slice lip section being disposed in each of the channel sections across the width of the machine.

14. The stock-inlet of claim 11, wherein the adjusting device comprises the downstream part of at least one of the first and second wall sections in each channel section being movable with respect to the other for adjusting the height of the outlet gap.

15. The stock-inlet of claim 14, wherein both the first and second walls are rigid and nonadjustable for purposes of adjusting the gap, and one of the walls includes a movable part supported to the one wall, disposed between the walls and adjustable toward and away from the other wall in a manner for converging the shape of the outlet channel along the pathway toward the outlet gap and in a manner for adjusting the height of the outlet gap.

16. The stock-inlet of claim 11, wherein the adjusting device comprises a downstream part of one of the first and second walls, which is adjustable in height across the outlet gap.

17. The stock-inlet of claim 2, wherein the wall sections defining each of the first and second walls are connected together at respective joints between adjacent wall sections;

a strip of flexible material disposed over at least one of the first and second walls inside the channel and extending over the joints between adjacent wall sections for evening out irregularities at the joints between wall sections of the respective wall on which the strip is provided.

18. The stock-inlet of claim 17, wherein the strip is attached to the respective wall by gluing over the whole surface of the wall.

19. The stock-inlet of claim 2, wherein each of the C-shaped channel sections is in the form of a one-piece, inherently rigid element including the respective first wall section, second wall section and the rear supporting element.

20. The stock-inlet of claim 2, wherein each channel section is formed only of a first wall section, a second wall section and the rear wall, without additional flow affecting means in the channel.

21. The stock-inlet of claim 1, wherein the rear supporting element includes at least one passage therethrough for the entrance of stock into the channel.

* * * * *